US007124805B2

(12) United States Patent
Alley

(10) Patent No.: US 7,124,805 B2
(45) Date of Patent: Oct. 24, 2006

(54) TUBE FEATURE FOR LIMITING INSERTION DEPTH INTO HEADER SLOT

(75) Inventor: Scot T. Alley, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/853,064

(22) Filed: May 24, 2004

(65) Prior Publication Data

US 2005/0257923 A1 Nov. 24, 2005

(51) Int. Cl.
*F28F 9/04* (2006.01)

(52) U.S. Cl. ..... 165/76; 165/173

(58) Field of Classification Search ..... 165/76, 165/173; 228/136, 183
See application file for complete search history.

(56) References Cited

U.S. PATENT DOCUMENTS 4,825,941 A 5/1989 Hoshino et al.
5,048,602 A 9/1991 Motohashi et al.
5,052,479 A * 10/1991 Nakajima et al. ..... 165/153
5,101,887 A * 4/1992 Kado ..... 165/76

FOREIGN PATENT DOCUMENTS

JP 01181963 A * 7/1989
JP 2002071293 A * 3/2002

* cited by examiner

*Primary Examiner*—Allen J. Flanigan
(74) *Attorney, Agent, or Firm*—Wood, Phillips, Katz, Clark & Mortimer

(57) ABSTRACT

An elongated flattened tube (10) includes a pair of dimples (30) spaced from an end (32) of the tube (10) to limit an insertion depth of the end (32) of the tube (10) into a tube slot (14) of a header (12) in a heat exchanger.

6 Claims, 2 Drawing Sheets

TUBE FEATURE FOR LIMITING INSERTION DEPTH INTO HEADER SLOT

FIELD OF THE INVENTION

This invention relates to heat exchangers, and more particularly, to heat exchangers having flattened tubes whose ends are received into conforming tube slots formed in a header.

BACKGROUND OF THE INVENTION

Heat exchangers utilizing flattened tubes having ends that are received in conforming tube slots of a header are well known. One concern with such heat exchanger constructions during assembly is the location of the end of the tube relative to the tube slot and associated header. If the tube is inserted too far into the tube slot, it can potentially interfere with the fluid flow through the header, or conversely, if the tube is not inserted far enough, it may fail to form an appropriate bond joint, such as when the construction is brazed or soldered to form a sealed joint between the tube and header.

It is known to modify the end of a tube by material removal and/or substantial deformation or resizing of the ends of the tubes. Examples of such approaches are shown in U.S. Pat. Nos. 5,101,887; 5,052,479; 5,048,602; and 4,825,941. While such approaches may be acceptable, they can require relative elaborate equipment, tooling, and the use of extruded tubes, and do not appear to be applicable to thin walled, welded or roll formed tubes. Accordingly, there is a continuing need for improvement in this area.

SUMMARY OF THE INVENTION

It is the primary object of the invention to provide a new and improved tube feature for limiting the insertion depth of a flattened tube into a header slot.

It is another object of the invention to provide an improved tube feature for limiting the insertion depth of a flattened tube into a header slot which does not require material removal and/or substantial deformation or resizing of the ends of the tubes.

According to one feature of the invention, an elongated flattened tube is provided for use in a heat exchanger having a header with a tube slot for receiving the tube. The tube includes a pair of oppositely facing broad side walls joined by a pair of oppositely facing convex edge walls to define a uniform transverse cross section over the length of the tube that conforms to the tube slot to be received therein. At least one interior flow path is enclosed by the walls to direct a fluid flow through the tube.

In accordance with one feature, the tube includes a localized concave dimple at a desired location spaced from an end of the tube to disrupt the uniform cross section at the location. The localized dimple is formed in one of the edge walls. The dimple creates a pair of bulges that interfere with the tube slot to limit an insertion depth of the end of the tube into the tube slot.

According to one feature, the tube includes a pair of localized concave dimples at a desired location spaced from an end of the tube to disrupt the uniform cross section at the location. One of the pair of localized dimples is formed in one of the edge walls, and the other of the pair of localized dimples is formed in the other of the edge walls. Each of the dimples creates a pair of bulges that interfere with the tube slot to limit an insertion depth of the end of the tube into the tube slot.

According to one feature, the dimple(s) has a curved bottom.

In one feature, the dimple(s) has a flat bottom.

In accordance with another feature of the invention, a method is provided for locating an end of an elongated flattened tube in a tube slot of a header. The method includes the steps of providing an elongated flattened tube having a pair of oppositely facing broad side walls joined by a pair of oppositely facing convex edge walls to define a uniform transverse cross section over the length of the tube that conforms to the tube slot to be received therein. At least one interior flow path is enclosed by the walls to direct a fluid flow through the tube. The method further includes the steps of: locally deforming one of the edge walls at a desired location spaced from an end of the tube so as to disrupt the uniform cross section at the location and create a pair of bulges; and inserting the end into the tube slot until the bulges prevent further insertion.

According to one feature, the step of locally deforming further includes locally deforming the other of the edge walls at the desired location so as to disrupt the uniform-cross section at the location and create another set of bulges.

Other objectives, features, and advantages of the invention will become apparent after review of the entire specification, including the appended claims and drawings.

DETAILED DESCRIPTION OF THE PREFERRED EMBODIMENT

Figure 1:
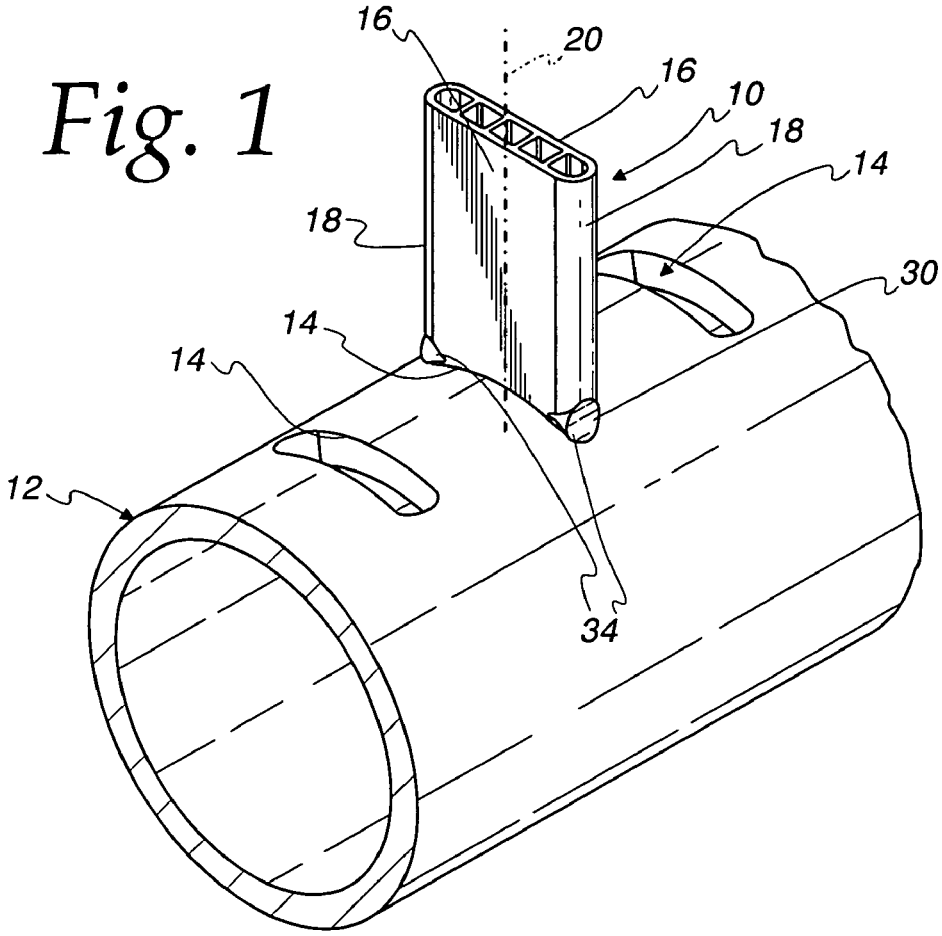
FIG. 1 is a broken, perspective view showing a tube embodying the present invention inserted into a header.
Figure 2:
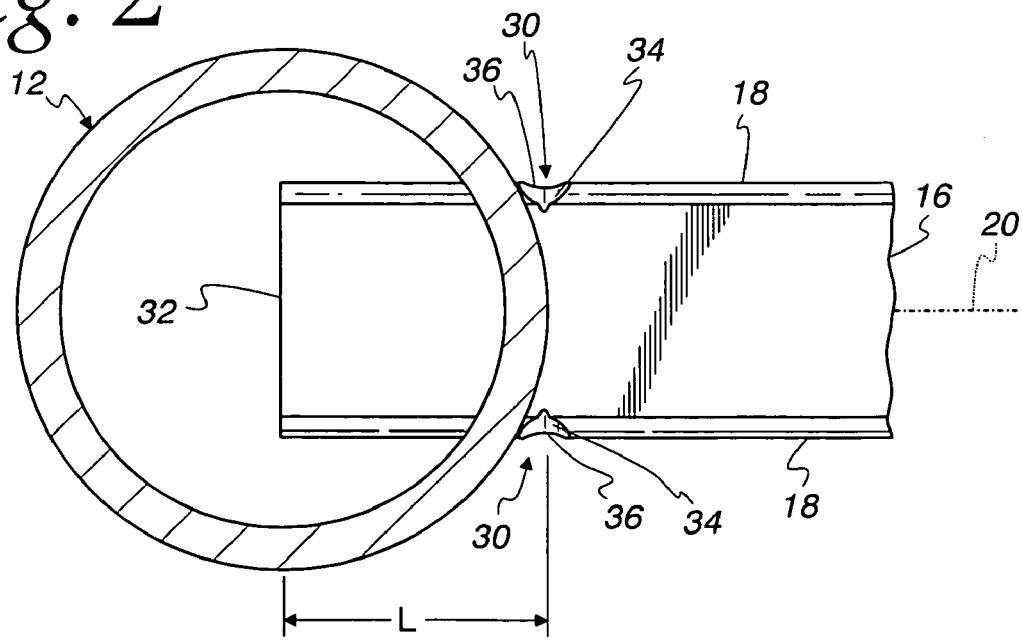
FIG. 2 is a view taken from line 2—2 in FIG. 1.
Figure 3:
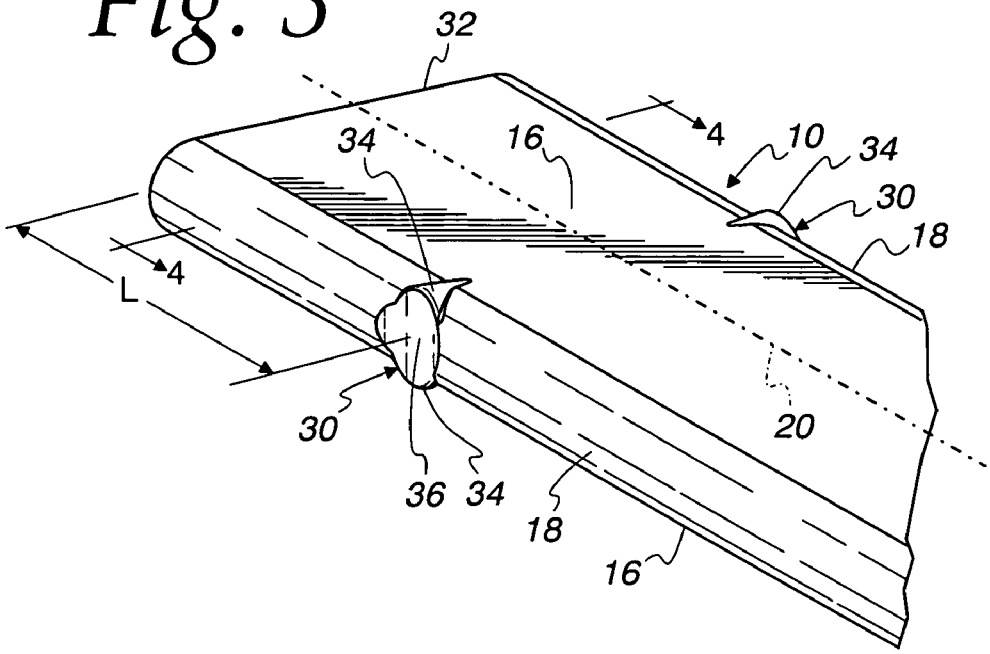
FIG. 3 is an enlarged, broken perspective view of the tube of FIG. 1, removed from the header.

With references to FIGS. 1 and 2, an elongated flattened tube 10 is provide for use in a heat exchanger having a header 12 with a tube slot 14 for receiving the tube 10. Although not shown, the heat exchanger would, in well known fashion, typically include a plurality of the tubes 10 with either serpentine or plate fins extending between each of the tubes 10 for the transfer of heat to a fluid flow passing over the exterior surface of the tubes and the fins. It should be understood that as used herein, the term header applies to any heat exchanger construction having a tube slot therein that receives the end of a tube, such as the tube 10, including the illustrated construction which is a cylindrical, one piece header or manifold design, or any other suitable construction, such as a so-called header plate and tank type construction.

Figure 4:
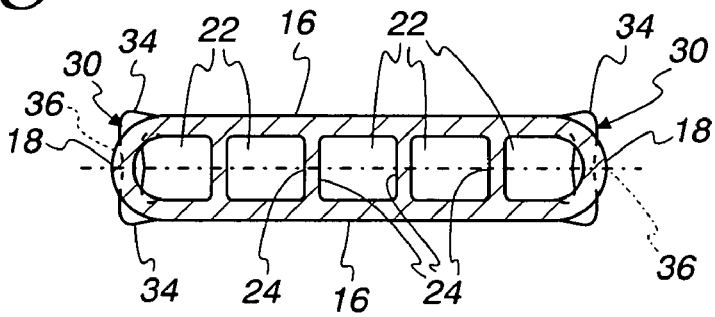
FIG. 4 is a view taken from line 4—4 in FIG. 3.

The tube 10 includes a pair of oppositely facing broad side walls 16 joined by a pair of oppositely facing curved or convex edge walls 18 to define a generally obround cross section, best seen in FIG. 4, transverse to a longitudinal axis 20 of the tube 10, with the cross section being uniform over the length of the tube and conforming to the tube slot 14 to be received therein and form a suitable bond joint therewith, such as by soldering or brazing. Again with reference to FIG. 4, the tube 10 also includes multiple interior ports or flow paths 22 separated by webs 24 and enclosed by the walls 16, 18 to direct a fluid flow through the tube 10. It should be understood that while a multi-port construction is shown, in some applications it may be desirable to use a single port or flow path constructions wherein the webs 24 are not included.

The tube also includes a pair of localized convex dimples or dents 30 at a desired location L spaced from an end 32 of the tube 10 to disrupt the uniform cross section at the location L. One of the dimples 30 is formed in one of the edge walls 18, and the other of the dimples 30 is formed in the other of the edge walls 18. As best seen in FIG. 4, the dimples 30 create a local transverse cross section for the tube that is non-conforming to the tube slot 14 to limit an insertion depth of the end 32 of the tube 10 into the tube slot 14, as best seen in FIG. 2. More specifically, the dimples 30 locally create a more rectangular shaped cross section, best seen in FIG. 4, for the tube that is non-conforming to the tube slot 14, which is obround in order to receive the obround cross section of the tube end 32. In this regard, each of the dimples 30 creates a pair of bulges 34 that interfere with the tube slot 14 to limit the insertion depth of the tube 10 therein.

Each of the dimples 30 is created by impacting or pressing a tool having the desired shape for the dimple into the edge wall 18 so as to plastically or permanently deform the material of the edge wall 18 to form the dimple 30 without requiring the removal of material and/or substantial deformation or reshaping of the end 32 of the tube 10. Accordingly, it should be understood that as used herein, the terms dimple or dent refer to a structural feature resulting from plastic or permanent deformation without the necessity of material removal. This operation is done after the tube 10 has been formed and can be performed either after the tube 10 has been cut to length, or during the tube cutting process. The depth of the dimple 30 can be adjusted to achieve the desired change in the shape of the uniform cross section to create the nonuniform cross section and the associated bulges 34. Experiments with a dimple 30 of approximately 0.010 inch depth have yielded a bulge 34 of approximately 0.004 inch which is sufficient in some applications for limiting the insertion depth of the tube 10.

Figure 5:
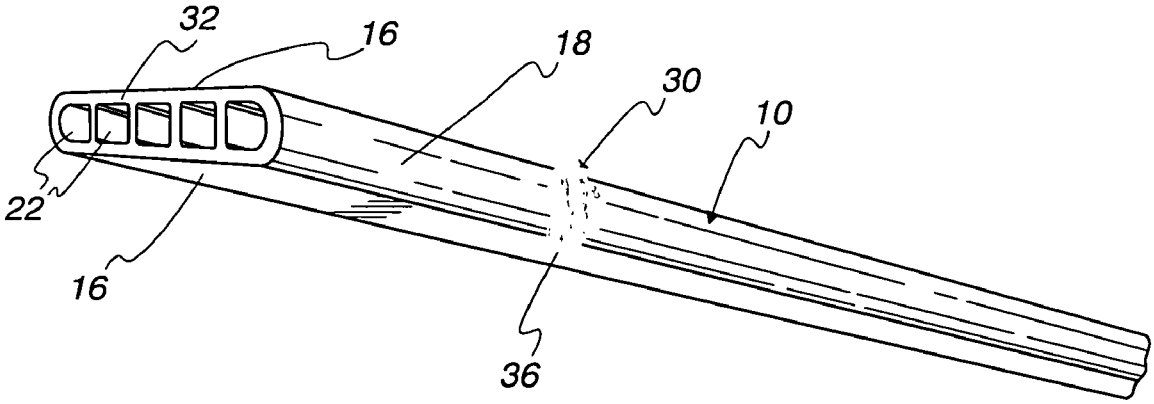
FIG. 5 is another perspective view of a tube embodying the present invention.

As seen for the embodiment illustrated in FIGS. 1–4, each of the dimples has a curved bottom 36, best seen in FIG. 2. Alternatively, as seen in FIG. 5, each of the dimples 30 can have a generally flat bottom 36.

It should be understood that while the tube 10 has been illustrated with a pair of the dimples 30, in some applications it may be desirable to only have a single dimple 30 formed in one of the edge walls 18.

It should be appreciated from the foregoing, that the dimples 30 can be applied to any tube 10, including extruded tubes, thin walled tubes, and welded or roll formed tubes. It is advantageous over conventional methods in that it does not require material removal and thus is not limited to use with extruded core tubes.

The invention claimed is:

1. An elongated flattened tube use in a heat exchanger having a header with a tube slot for receiving the tube, the tube comprising:

a pair of oppositely facing broad side walls joined by a pair of oppositely facing convex edge walls to define a uniform transverse cross section over the length of the tube, said cross-section conforming to said tube slot to be received therein, at least one interior flow path enclosed by said walls to direct a fluid flow through the tube; and a pair of localized concave dimples at a desired location spaced from an end of the tube to disrupt said uniform cross section at said location, one of said pair of localized dimples formed in one of said edge walls, the other of said pair of localized dimples in the other of said edge walls, each of said dimples creating a pair of bulges that interfere with the tube slot to limit an insertion depth of said end of the tube into the tube slot.

2. The tube of claim 1 wherein each of said dimples has a curved bottom.

3. The tube of claim 1 wherein each of said dimples has a flat bottom.

4. An elongated flattened tube use in a heat exchanger having a header with a tube slot for receiving the tube, the tube comprising:

a pair of oppositely facing broad side walls joined by a pair of oppositely facing convex edge walls to define a uniform transverse cross section over the length of the tube, said cross section conforming to said tube slot to be received therein, at least one interior flow path enclosed by said walls to direct a fluid flow through the tube; and a localized dimple at a desired location spaced from an end of the tube to disrupt said uniform cross section at said location, said localized dimple formed in one of said edge walls, said dimple creating a pair of bulges that interferes with the tube slot to limit an insertion depth of said end of the tube into the tube slot.

5. The tube of claim 4 wherein said dimple has a convex cross section with a curved bottom.

6. The tube of claims 4 wherein said dimple has a channel shaped cross section.

* * * * *